US006613704B1

(12) United States Patent
Arnold et al.

(10) Patent No.: US 6,613,704 B1
(45) Date of Patent: Sep. 2, 2003

(54) CONTINUOUS FILAMENT COMPOSITE NONWOVEN WEBS

(75) Inventors: Billy Dean Arnold, Alpharetta, GA (US); David Lewis Myers, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 140 days.

(21) Appl. No.: 09/689,046

(22) Filed: Oct. 12, 2000

Related U.S. Application Data

(60) Provisional application No. 60/159,288, filed on Oct. 13, 1999.

(51) Int. Cl.[7] ..... D04H 1/00; D04H 13/00; D04H 3/00; D04H 5/00

(52) U.S. Cl. ..... 442/361; 442/362; 442/366; 442/352; 428/212; 428/213; 428/371

(58) Field of Search ..... 442/361, 362, 442/366, 352; 428/212, 213, 371

(56) References Cited

U.S. PATENT DOCUMENTS 3,338,992 A * 8/1967 Kinney
3,341,394 A * 9/1967 Kinney
3,423,266 A * 1/1969 Davies et al.
3,502,763 A * 3/1970 Hartman
3,542,615 A * 11/1970 Dobo et al.
3,589,956 A 6/1971 Kranz et al.
3,595,731 A * 7/1971 Davies et al.
3,692,618 A * 9/1972 Dorschner et al.
3,802,817 A * 4/1974 Matsuki et al.
3,849,241 A * 11/1974 Butin et al.
3,855,046 A * 12/1974 Hansen et al.
3,940,302 A * 2/1976 Matthews et al. ..... 156/167
3,949,128 A * 4/1976 Ostermeier
3,973,068 A * 8/1976 Weber
4,041,203 A * 8/1977 Brock et al.
4,070,218 A * 1/1978 Weber
4,340,563 A * 7/1982 Appel et al.
4,374,888 A * 2/1983 Bornslaeger
4,375,718 A * 3/1983 Wadsworth et al.
4,526,733 A * 7/1985 Lau
4,551,378 A * 11/1985 Carey, Jr. ..... 156/308.2
4,588,537 A * 5/1986 Klaase et al.
4,663,220 A * 5/1987 Wisneski et al.
4,707,398 A * 11/1987 Boggs
4,720,415 A * 1/1988 Vander Wielen et al.
4,795,668 A * 1/1989 Krueger et al.

(List continued on next page.)

FOREIGN PATENT DOCUMENTS

EP 0400333 B1 * 11/1985
EP 0372572 6/1990
EP 0475307 B1 * 11/1995
EP 0475306 B1 * 3/1997
EP 0837162 4/1998
WO 97/49848 * 12/1997
WO 00/00267 1/2000
WO 00/06813 2/2000
WO 00/37723 6/2000

OTHER PUBLICATIONS

International Search Report dated Jun. 17, 2002, for International Application No. PCT/US01/31961.

*Primary Examiner*—Elizabeth M. Cole
*Assistant Examiner*—Norca L. Torres
(74) *Attorney, Agent, or Firm*—Ralph H. Dean, Jr.

(57) ABSTRACT

Nonwoven webs of continuous filaments are provided having a mixture or blend of first and second continuous filaments wherein the first and second continuous filaments are different from the first continuous filaments in one or more respects such as size, cross-sectional shape, polymer composition, crimp level, wettability, liquid repellency, and charge retention. The second continuous filaments can be substantially surrounded by the first continuous filaments wherein the ratio of first continuous filaments to second continuous filaments exceeds about 2:1.

18 Claims, 1 Drawing Sheet

U.S. PATENT DOCUMENTS 4,803,117 A * 2/1989 Daponte
4,833,003 A * 5/1989 Win et al.
4,853,281 A * 8/1989 Win et al.
4,855,360 A * 8/1989 Duchesne et al.
4,863,983 A * 9/1989 Johnson et al.
4,965,122 A * 10/1990 Morman
4,997,611 A 3/1991 Hartmann
5,025,052 A * 6/1991 Crater et al.
5,057,368 A * 10/1991 Largman et al.
5,069,970 A * 12/1991 Largman et al.
5,108,820 A * 4/1992 Kaneko et al.
5,145,727 A * 9/1992 Potts et al.
5,160,746 A * 11/1992 Dodge, II et al.
5,188,885 A * 2/1993 Timmons et al.
5,204,429 A * 4/1993 Kaminsky et al.
5,208,304 A * 5/1993 Waymouth
5,212,246 A * 5/1993 Ogale
5,271,883 A * 12/1993 Timmons et al.
5,272,236 A * 12/1993 Lai et al.
5,277,976 A * 1/1994 Hogle et al.
5,278,272 A * 1/1994 Lai et al.
5,294,482 A * 3/1994 Gessner ..... 428/373
5,331,047 A * 7/1994 Giacobbe
5,332,613 A * 7/1994 Taylor et al.
5,336,545 A * 8/1994 Morman
5,336,552 A * 8/1994 Strack et al.
5,344,297 A * 9/1994 Hills
5,366,793 A * 11/1994 Fitts, Jr. et al.
5,382,400 A * 1/1995 Pike et al.
5,385,775 A * 1/1995 Wright
5,401,446 A * 3/1995 Tsai et al.
5,439,734 A * 8/1995 Everhart et al.
5,451,450 A * 9/1995 Erderly et al.
5,459,188 A * 10/1995 Sargent et al.
5,466,410 A * 11/1995 Hills
5,472,775 A * 12/1995 Obijeski et al.
5,486,166 A * 1/1996 Bishop et al.
5,534,339 A * 7/1996 Stokes
5,539,124 A * 7/1996 Etherton et al.
5,540,976 A * 7/1996 Shawver et al.
5,554,775 A * 9/1996 Krishnamurti et al.
5,562,650 A * 10/1996 Everett et al.
5,594,080 A * 1/1997 Waymouth et al.
5,620,779 A * 4/1997 Levy et al.
5,639,541 A * 6/1997 Adam
5,652,048 A * 7/1997 Haynes et al.
5,660,910 A 8/1997 Hoyt et al.
5,695,868 A * 12/1997 McCormack
5,696,191 A * 12/1997 Nohr et al.
5,707,735 A * 1/1998 Midkiff et al.
5,714,107 A * 2/1998 Levy et al.
5,721,180 A * 2/1998 Pike et al.
5,795,926 A * 8/1998 Niessner et al.
5,798,402 A * 8/1998 Fitzgerald et al.
5,811,178 A * 9/1998 Adam et al.
5,817,584 A * 10/1998 Singer et al.
5,853,635 A 12/1998 Morell et al.
5,989,004 A * 11/1999 Cook
6,053,719 A 4/2000 Barbier et al.
6,274,521 B1 * 8/2001 Barbier et al. ..... 442/327
6,286,145 B1 * 9/2001 Welchel et al. ..... 128/873
6,352,948 B1 * 3/2002 Pike et al. ..... 442/361
6,365,088 B1 * 4/2002 Knight et al. ..... 246/438

* cited by examiner

CONTINUOUS FILAMENT COMPOSITE NONWOVEN WEBS

This application claims the benefit of provisional application Ser. No. 60/159,288 filed Oct. 13, 1999.

FIELD OF THE INVENTION

The present invention relates to continuous filament nonwoven webs.

BACKGROUND OF THE INVENTION

There exist a variety of processes for forming continuous filament nonwoven webs. The spunbond fiber process is one example. Generally speaking, methods for making spunbond fiber nonwoven webs include extruding molten thermoplastic polymer through a spinneret and drawing the extruded polymer into filaments to form a web of randomly arrayed fibers on a collecting surface. As examples, methods for making the spunbond fiber webs are described in U.S. Pat. No. 4,692,618 to Dorschner et al., U.S. Pat. No. 4,340,563 to Appel et al. and U.S. Pat. No. 3,802,817 to Matsuki et al. A second and distinct process for making continuous filament nonwoven webs is the meltblowing process. Meltblown fiber webs are generally formed by extruding a molten thermoplastic material through a plurality of fine die capillaries as molten threads or filaments into converging high velocity air streams which attenuate the filaments of molten thermoplastic material to reduce their diameter. Thereafter, the meltblown fibers are deposited on a collecting surface to form a web of randomly dispersed meltblown fibers. Meltblown fiber processes are disclosed in, by way of example only, U.S. Pat. No. 3,849,241 to Butin et al., U.S. Pat. No. 5,160,746 to Dodge et al. and U.S. Pat. No. 4,526,733 to Lau.

Continuous filament nonwoven webs have found industrial applicability in a wide range of products and/or uses. As examples, continuous filament nonwoven webs have heretofore been used as filtration and/or barrier type materials such as in facemasks, sterilization wraps, HVAC media, surgical gowns, industrial workwear and so forth. Additionally, continuous filament nonwoven webs have been widely used as one or more components of personal care products. As examples, continuous filament nonwoven webs have been used in a variety of components ranging from liquid distribution layers, composite absorbent materials, baffles, coverstock and so forth. However, while continuous filament nonwovens have found wide acceptance within various industries the demands upon the physical attributes and/or performance of existing materials continues to increase. In addition, by improving the physical attributes and/or performance of continuous filament nonwoven materials the materials can be utilized in still a wider array of applications and products.

Thus, there exists a need for continuous filament nonwoven webs having improved and/or specialized physical attributes and functionality. More particularly, there exists a need for specialized continuous filament nonwoven webs having improved liquid handling properties, treatment retention and location, hand (i.e. softness), resiliency, durability, stretch-recovery and/or other desirable properties.

SUMMARY OF THE INVENTION

The aforesaid needs are fulfilled and the problems experienced by those skilled in the art overcome by nonwoven webs of the present invention comprising a unitary continuous filament nonwoven web comprising a composite of at least first and second continuous filaments. In one aspect of the present invention, the continuous filament nonwoven web comprises a blend or mixture of first continuous filaments and second continuous filaments wherein the second continuous filaments are different from the first continuous filaments. Desirably the second continuous filaments are substantially surrounded by the first continuous filaments.

In a further aspect, composite nonwoven webs of the present invention can comprise first and second continuous filaments that extend substantially in the machine direction and wherein the first continuous filaments comprise multicomponent filaments and the second continuous filaments comprise monocomponent filaments. The first continuous filaments can comprise at least about 50% of said composite nonwoven web and can also have an average denier less than that of the said first continuous filaments. The composite nonwoven web can also be through air bonded and have autogenous interfiber bonds. Further, the second continuous filaments can, in one aspect, comprise from about 10% to about 40% of the composite nonwoven web. Still further, first continuous filaments and second continuous filaments desirably have a denier ratio of not less than about 2:1. The first continuous filaments can be crimped or uncrimped filaments. In addition, the polymer composition comprising one of the components within the first continuous filaments desirably has a melting point at least 10° C. below that of the polymer composition comprising the other components therein as well as the polymer composition comprising the second continuous filaments. As a particular example, the first continuous filaments can comprise polypropylene/polyethylene bicomponent filaments and the second continuous filaments can comprise polypropylene. The composite nonwoven web can, optionally, be treated so as to form an electret.

In still a further aspect of the invention, composite nonwoven webs of the present invention can comprise first continuous filaments and second continuous filaments extending substantially in the machine direction and that have different surface properties from one another and wherein the ratio of first continuous filaments to second continuous filaments is at least about 2:1. Desirably only one of said first and second continuous filaments contain an effective amount of an active agent selected from the group consisting of wetting agents, anti-static agents, alcohol repellency agents, odor-control agents, electret stabilizing agents, and so forth. The second filaments can, in one aspect, have a larger average denier than said first continuous filaments. Further, the first and second filaments can comprise either multicomponent filaments or monocomponent filaments. Either the first and/or second continuous filaments can be shaped filaments, i.e. having a non-round cross-section.

DEFINITIONS

Figure 1:
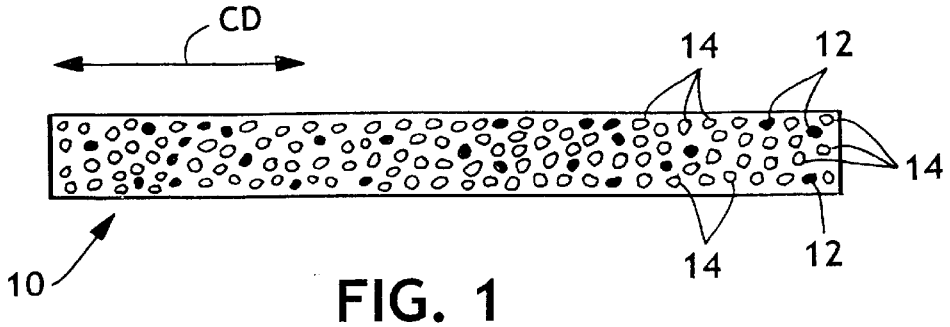
FIG. 1 is a cross-sectional view of a composite nonwoven web comprising a blend of first and second filaments.

As used herein and in the claims, the term "comprising" is inclusive or open-ended and does not exclude additional unrecited elements, compositional components, or method steps.

As used herein the term "nonwoven" fabric or web means a web having a structure of individual fibers or threads which are interlaid, but not in an identifiable manner as in a knitted or woven fabric. Nonwoven fabrics or webs can be formed by various processes including, but not limited to, meltblowing processes and spunbonding processes.

As used herein the term "continuous filament" refers to a filament that has a high aspect ratio (length/diameter) such as, for example, exceeding about 500,000/1.

As used herein the term "spunbond fibers" refers to small diameter fibers of mechanically and/or eductively drawn polymeric material. Spunbond fibers are generally formed by extruding molten thermoplastic material as filaments from a plurality of fine capillaries of a spinneret with the diameter of the extruded filaments then being rapidly reduced. Examples of spunbond fibers and methods of making the same are described in, by way of example only, U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al, U.S. Pat. No. 5,382,400 to Pike et al. and U.S. Pat. No. 5,795,926 to Pike et al.; the entire content of the aforesaid patents are incorporated herein by reference. Spunbond fibers are generally not tacky when they are deposited onto a collecting surface and are continuous.

As used herein the term "meltblown fibers" means fibers of polymeric material which are generally formed by extruding a molten thermoplastic material through a plurality of die capillaries as molten threads or filaments into converging high velocity air streams which attenuate the filaments of molten thermoplastic material to reduce their diameter. Thereafter, the meltblown fibers can be carried by the high velocity gas stream and are deposited on a collecting surface to form a web of randomly dispersed meltblown fibers. Meltblowing process are disclosed in, by way of example only, in U.S. Pat. No. 3,849,241 to Butin et al., U.S. Pat. No. 5,271,883 to Timmons et al., U.S. Pat. No. 5,160,746 to Dodge et al., U.S. Pat. No. 4,526,733 to Lau, U.S. Pat. No. 5,652,048 to Haynes et al. and U.S. Pat. No. 5,366,793 to Fitts et al.; the entire contents of the aforesaid references are incorporated herein by reference. Meltblown fibers are generally smaller than about 10 microns in average diameter and, unlike spunbond fibers, are generally tacky when deposited onto a collecting surface, thereby bonding to one another during the deposition step.

As used herein, "ultrasonic bonding" means a process performed, for example, by passing the fabric between a sonic horn and anvil roll as illustrated in U.S. Pat. No. 4,374,888 to Bornslaeger.

As used herein "point bonding" means bonding one or more layers of fabric at numerous small, discrete bond points. As an example, thermal point bonding generally involves passing one or more layers to be bonded between heated rolls such as, for example, an engraved patterned roll and a second roll. The engraved roll is patterned in some way so that the fabric is not bonded over its entire surface, and the second roll can be flat or patterned. As a result, various patterns for engraved rolls have been developed for functional as well as aesthetic reasons. One example of a pattern has diamond shaped points and is the Hansen Pennings or "H&P" pattern with about a 30% bond area and with about 200 bonds/square inch as taught in U.S. Pat. No. 3,855,046 to Hansen et al.

As used herein, the term "machine direction" or MD means the direction of the fabric in the direction in which it is produced. The term "cross machine direction" or CD means the direction of the fabric substantially perpendicular to the MD.

As used herein the term "wetting agent" refers to any chemical compound or composition that makes a fiber surface exhibit increased hydrophilic characteristics such as by lowering the contact angle of an aqueous fluid that comes in contact with the fiber surface.

As used herein the term "liquid repellency agent" refers to any chemical compound or composition that makes a fiber surface exhibit increased barrier or repellency characteristics for a particular liquid such as by increasing the contact angle for the particular liquid that comes in contact with the fiber surface.

As used herein, the term "autogenous bonding" refers to bonding between discrete parts and/or surfaces independently of mechanical fasteners or external additives such as adhesives, solders, and the like.

DESCRIPTION OF THE INVENTION

In reference to FIG. 1, continuous filament nonwoven web 10 can comprise a composite, i.e. a combination of different elements, of first continuous filaments 12 and second continuous filaments 14 wherein the second continuous filaments 14 are different from the first continuous filaments 12. Both the first continuous filaments and the second continuous filaments extend substantially in the machine direction. The first and second filaments are different from one another and can vary in one or more respects. By way of example, the first and second filaments can vary with respect to average fiber size or denier, cross-sectional shape (e.g. round, crescent, multi-lobal, flat, and so forth), cross-sectional configuration (e.g. monocomponent and multicomponent), polymer composition, crimp level, treatment level or type, additive composition and so forth. Continuous filaments nonwoven webs can be made substantially in accord with conventional nonwoven web forming processes mentioned herein above. However, as described herein below, conventional continuous filament web forming process can be varied in one or more respects to achieve a nonwoven web comprising a composite structure. The respective filaments can have a 1:1 ratio to about a 100:1 ratio. The second filaments are desirably positioned within the web such that they have insignificant or minimal contact with like fibers. For example, desirably the first filaments substantially surround the second filaments. In this regard, the ratio of first filaments to second filaments is desirably greater than about 2:1 and still more desirably between about 5:1 and about 50:1.

As one example, the first continuous filaments can comprise filaments having a smaller denier than the second continuous filaments. Desirably, the second continuous filaments have an average diameter of at least about 10 micrometers larger than that of the first continuous filaments and still more desirably have an average diameter at least about 20 micrometers larger than that of the first continuous filaments. In one aspect, the first continuous filaments can have an average diameter of between about 0.1 and about 20 micrometers and the second continuous filaments have an average denier between about 20 and about 150 micrometers. One or more methods can be utilized to achieve distinct fiber diameters. Firstly, distinct fiber diameters can be achieved by employing different sized exit orifices or outlet openings in the spin plate or die body. Further, distinct fiber sizes can also be achieved using polymers in the first and second filaments that have significantly different melt-flow rates. In one embodiment, the first or smaller diameter fibers can be solid fibers and the second or larger fibers can be hollow fibers. Hollow fibers can be made by various methods known in the art such as, for example, by using a plurality of arced exit slots whereby swelling of the polymer after extrusion causes the molten polymer to form a fiber having a hollow center.

In a further aspect, the first filaments can comprise a different shape than the second filaments. As an example, the first filaments can comprise round fibers and the second filaments can comprise a distinct cross-sectional shape such as, for example, a crescent shape, multilobal shape, ribbon shape as well as other geometric or non-geometric shapes. The variation in fiber size and/or shape can be achieved by employing a spinneret, die or spin plate having distinct outlet openings for the first and second continuous filaments. The respective outlet openings can have the shape necessary to achieve the desired cross-sectional shape and methods of spinning fibers having various shapes are known in the art such as, for example, as described in U.S. Pat. No. 5,707,735 to Midkiff et al., U.S. Pat. No. 5,277,976 to Hogle et al., U.S. Pat. No. 5,466,410 to Hills and U.S. Pat. Nos. 5,069,970 and 5,057,368 to Largman et al. Further, varied and distinct fiber shapes can be achieved by splitting one or both of the first and second continuous filaments.

In a further aspect, the first and second filaments can comprise different polymer compositions. By providing filaments comprising distinct polymer composition it is possible to achieve a nonwoven web having improved tensile strength, durability, elasticity, wettability, three-dimensional structure and/or other characteristics. The first and second filaments can be selected from thermoplastic polymers including, but not limited to, polyolefins (e.g., polypropylene and polyethylene), polybutylenes, polycondensates (e.g., polyamides, polyesters, polycarbonates, and polyarylates), polyols, polydienes, polyurethanes, polyethers, polyacrylates, polyacetals, polyimides, cellulose esters, polystyrenes, fluoropolymers, and so forth. The particular polymer composition of the first and second filaments can be selected to achieve or enhance the desired physical attributes of the resulting composite nonwoven web.

Providing nonwoven fabrics comprising a mixture of distinct filaments, e.g. cross-sectional configuration and/or polymer composition, can be achieved by modifying conventional spin pack assemblies. Spin packs generally comprise a series of stacked plates that have a pattern of interconnecting channels and/or apertures through which a multiple polymer streams can flow. The polymer streams are maintained separate as the respective polymer streams flows throughout the spin pack, spinneret and/or die. Examples of such spin packs are described in U.S. Pat. Nos. 5,344,297 and 5,466,410 to Hills and U.S. Pat. No. 5,989,004 to Cook; the entire contents of which are incorporated herein by reference. These spin packs can be modified to deliver the respective polymer streams to the desired outlet openings within the spinneret and/or die. In addition, composite nonwoven webs comprising first and second filaments can be achieved by aggressively merging separate fiber streams, prior to web laydown, to create a single coflowing filament stream upon exit from the fiber draw unit. This may be accomplished by methods described in U.S. Pat. No. 5,853,635 to Morell et al., the entire contents of which are incorporated herein by reference. In order to achieve more disparate filament ratios, it is possible to further modify Morell by providing a first spinpack that extrudes only first filaments and a second spinpack that extrudes the first filaments and a minor portion of second filaments. After web formation, i.e. fiber laydown, the web can be further acted upon or processed as desired. As an example, the composite web can be thermal point bonded and/or through-air bonded in order to impart additional integrity to the web.

As a further example, the first filaments can comprise an extensible filament of a first polymer and the second filaments can comprise an elastic filament of a second polymer having superior elastic recovery properties (relative to that of the first polymer). Suitable elastic filaments can comprise, by way of example only, elastic polyesters, polyurethanes, polystyrenes, polyolefins and so forth. Exemplary thermoplastic elastomers and/or elastomeric fibers suitable for use with the present invention include, but are not limited to, those described in U.S. Pat. No. 5,332,613 to Taylor et al., U.S. Pat. No. 4,803,117 to Daponte, U.S. Pat. No. 4,707,398 to Boggs et al., U.S. Pat. No. 4,663,220 to Wisneski et al., U.S. Pat. Nos. 5,278,272 and 5,272,236 to Lai et al., U.S. Pat. No. 5,472,775 to Obijeski et al., U.S. Pat. No. 5,331,047 to Giacobbe et al. and EP Patent No. 0400333B1. As one example, the first continuous filaments can comprise a polyolefin elastomer and the second continuous filament can comprise a blend of a polyolefin and a polymer having improved elastic recovery properties such as, for example, KRATON polymer available from the Shell Chemical Company. KRATON polymers comprise a block copolymer having the general formula A-B-A' where A and A' are each a thermoplastic polymer endblock which contains a styrenic moiety such as a poly (vinyl arene) and B is an elastomeric polymer midblock such as a conjugated diene or a lower alkene polymer.

As a further example, the first filaments can comprise a first polyolefin and the second filaments can comprise a second polyolefin. In this regard, the first filaments can comprise polypropylene and the second filaments can comprise a distinct blend or copolymer such as propylene-ethylene copolymers, propylene-butylene copolymers, KRATON/polypropylene blends and so forth. In addition, it is noted that there exist a wide variety of polymers having distinct characteristics and yet which comprise substantially similar and/or identical repeat units. For example, two polymers can each comprise substantial amounts of propylene and yet comprise different polymers for purposes of the present invention. Polymers having identical monomers or repeat units and distinct physical properties (e.g. melt-flow rates, polydispersity numbers, modulus of elasticity, melt-flow rates and so forth) can be achieved through the use of different synthesis steps and/or catalysts. Various polyolefin polymers having varied physical attributes, and thus comprising different polymers, are described in U.S. Pat. No. 5,300,365 to Ogale, U.S. Pat. No. 5,212,246 to Ogale, U.S. Pat. No. 5,331,047 to Giacobbe, U.S. Pat. No. 5,451,450 to Elderly et al., U.S. Pat. No. 5,204,429 to Kaminsky et al., U.S. Pat. No. 5,539,124 to Etherton et al., U.S. Pat. Nos. 5,278,272 and 5,272,236 both to Lai et al., U.S. Pat. No. 5,554,775 to Krishnamurti et al., U.S. Pat. No. 5,549,080 to Waymouth et al., U.S. Pat. No. 5,208,304 to Waymouth, U.S. Pat. No. 5,539,124 to Etherton et al., European Patent No. 0475307B1 and European Application No. 0475306A1. As an example, the first filaments can comprise an inelastic or crystalline polypropylene polymer and the second filaments can comprise polyolefin elastomers.

As a further example, the second filaments can comprise a lower melting and/or or tacky polymer in order to improve overall web integrity. In this regard, the first filament can comprise a polypropylene polymer and the second polymer can comprise an amorphous polyalphaolefin such as, for example, a copolymer of propylene and 1-butene available under the trade designation REXTAC 2730 from Huntsman Corporation. Subsequent heating and/or bonding operations can cause the tacky or low melting second continuous filaments to form extensive, autogenous bonding that improves the overall integrity of the nonwoven web.

In a further aspect, the second filament can comprise a polymer having improved (relative to the first filaments) wetting, wicking and/or absorbency characteristics in order to improve the fluid handling properties of the web. The improved liquid handling properties can be achieved by selecting a polymer that inherently has better wetting or absorbency characteristics. Further, first or second filaments can be provided having improved liquid handling properties by providing the selected filaments with treatments or additives designed to impart and/or improved liquid handling properties of the resulting filaments. Thus, by the latter method, the first and second filaments can comprise the same or similar polymers and yet have distinct liquid handling properties. Numerous additives and/or treatments for imparting wettability to polyolefin fibers are known in the art. As one example, first continuous filaments can comprise polypropylene spunbond fibers and the second continuous filaments can comprise spunbond fibers comprising a blend of polypropylene and di-fatty acid esters of polyethylene oxides, such as described in U.S. Pat. No. 5,349,734 to Everhart et al., whereby the second continuous filaments will have superior wettability than the first continuous filaments. As further examples, exemplary wetting agents that can be melt-processed within one of the segments in order to impart improved wettability to the fiber include, but are not limited to, ethoxylated silicone surfactants, ethoxylated hydrocarbon surfactants, ethoxylated fluorocarbon surfactants and so forth. In addition, exemplary chemistries useful in making melt-processed thermoplastic fibers more hydrophilic are described in U.S. Pat. Nos. 3,973,068 and 4,070,218 to Weber et al. and U.S. Pat. No. 5,696,191 to Nohr et al.; the entire contents of the aforesaid references are incorporated herein by reference.

In a further aspect, first and second filaments can comprise filaments having or including different treatments and/or additives and which therefore result in filaments with distinct physical attributes. Various fiber treatments and/or additives are known in the art and can be used to improve and/or impart desired physical attributes to the selected filaments such as, for example, UV stability, liquid handling properties, flame-retardancy, anti-static properties, odor control properties, anti-bacterial properties, liquid repellency and so forth. These and other treatments and/or additives can be selectively added to the first and/or second filaments such that the first and second filaments have distinct physical attributes. As particular examples, chemical compositions suitable for use in melt-extrusion processes and that improves alcohol repellency include, but are not limited to, fluorochemicals. Various active agents suitable for imparting alcohol repellency to thermoplastic fibers are described in U.S. Pat. No. 5,145,727 to Potts et al., U.S. Pat. No. 4,855,360 to Duchesne et al., U.S. Pat. No. 4,863,983 to Johnson et al., U.S. Pat. No. 5,798,402 to Fitzgerald et al. and U.S. Pat. Nos. 5,459,188 and 5,025,052; the entire contents of the aforesaid references are incorporated herein by reference. In addition to alcohol repellency, chemical compositions can be used to similarly improve the repellency or barrier properties for other low surface tension liquids.

In a further aspect of the invention, the first and second filaments can comprise polymers with distinct shrinkage characteristics. In this regard, by selecting first filaments and second filaments having differing shrinkage characteristics it is possible to provide a nonwoven web having an irregular and/or undulated topography. As a specific example, first polyolefin fibers and second polyester fibers can be extruded by one of the processes discussed above and, subsequent to web formation and bonding, the web can be heat treated thereby causing significantly greater shrinkage in the polyester fibers. The length-wise shrinking of the polyester fibers can cause the bonded nonwoven web to pucker, providing the web with an irregular and/or a crenellated structure.

In a further aspect of the invention, the first continuous filaments can comprise monocomponent fibers and the second continuous filaments can comprise multiconstituent or multicomponent filaments. The multicomponent fibers can have any one of various configurations such as, for example, side-by-side, concentric sheath/core, eccentric sheath/core, islands-in-sea and so forth. Multicomponent fibers, including bicomponent fibers, and methods of making the same are known in the art and, by way of example only, are generally described in U.S. Pat. No. 5,108,820 to Kaneko et al., U.S. Pat. No. 4,795,668 to Krueger et al., U.S. Pat. No. 5,336,552 to Strack et al., U.S. Pat. No. 5,382,400 to Pike et al., U.S. Pat. No. 5,277,976 to Hogle et al., U.S. Pat. No. 5,466,410 to Hills, U.S. Pat. Nos. 3,423,266 and 3,595,731 both to Davies et al., U.S. Pat. No. 5,534,339 to Stokes et al., and PCT application WO97/49848 to Griesbach. The blend or mixture of filaments can be achieved as described herein above by correspondingly altering the spinpacks and/or polymer distribution means. In one aspect, the first filaments can comprise a single component polyolefin and the second filaments can comprise multicomponent filaments wherein at least one of the components comprises a polyolefin exposed upon a portion of the outer surface of the fiber. As a particular example, the first filaments can comprise a monocomponent polypropylene filament and the second filaments can comprise side-by-side bicomponent fibers where one component comprises polypropylene such as, for example, a polyethylene/polypropylene bicomponent filament. In a further aspect, the first filaments can comprise elastic filaments and the second filaments can comprise highly crimped filaments whereby the composite nonwoven web exhibits good stretch and recovery properties in the MD. In this regard, the crimped filaments can be extended by pulling out the crimp and the second or elastic filaments provide sufficient recovery properties to cause the entire web to retract after the elongating force is removed.

In a further aspect, the first filaments can comprise first multicomponent filaments and the second filaments can comprise different multicomponent filaments. In this regard the multicomponent fibers can vary with respect to polymer composition of one or more components, shape, denier, crimp level, and so forth. In one aspect, the first and second multicomponent filaments desirably each comprise at least one polyolefin component and still more desirably each comprise a similar and/or identical polyolefin component. In one particular embodiment, the first filaments can comprise polyethylene/polypropylene side-by-side filaments and the second filaments can comprise polyethylene/polyamide side-by-side filaments. In a further particular embodiment, the first filaments can comprise polyethylene/nylon side-by-side filaments and the second filaments can comprise polyethylene/nylon sheath/core filaments wherein the polyethylene comprises the sheath component. By varying the number and spacing of the second filaments, a nonwoven web can be engineered to maintain certain desired attributes while improving various improved properties such as strength, durability, pressure drop and/or bulk. Notably, by varying the additive concentration, shape and/or polymer composition of respective components, the nonwoven web can be formed having a selected percentage of highly crimped and/or uncrimped filaments thereby allowing one to engineer a fabric having desired web densities and/or air permeability.

As a particular example, the nonwoven webs of the present invention can comprise a major portion of multicomponent fibers and a minor portion of monocomponent fibers. The multicomponent fibers, e.g. bicomponent fibers, desirably comprise crimped filaments and the monocomponent fibers desirably comprise substantially uncrimped filaments. In a further aspect, the monocomponent fibers can have a smaller denier than the multicomponent fibers. Desirably the multicomponent fibers and monocomponent fibers have a denier ratio between about 2:1 and 15:1 and still more desirably about 4:1. The crimped multicomponent filaments can be made using a spunbond process and spin pack assembly as described in U.S. Pat. No. 5,382,400 to Pike et al. and U.S. Pat. No. 5,989,004 to Cook, the entire contents of which are incorporated herein by reference. The monocomponent fibers can be made by utilizing stacked spin plate assemblies for forming multicomponent fibers with the exception that the last plate, in direct fluid communication with the spinneret, has selected outlets which block and/or substantially restrict flow of one of the polymer streams to that particular spinneret outlet opening. Due to the reduced polymer flow to selected spinneret outlet openings, a nonwoven fabric can be made having multicomponent filaments and a selected number and location of monocomponent filaments. In this regard, a nonwoven web comprising a filtration fabric can be prepared comprising a major portion of crimped multicomponent filaments and a minor portion of uncrimped monocomponent filaments wherein the monocomponent filaments comprise from about 10% to about 40% of the composite nonwoven web and still more desirably wherein the monocomponent filaments comprise between about 20% to about 35% of the composite nonwoven web (where percent is based upon the number of fibers). In a particular aspect the multicomponent fibers can comprise polyethylene/polypropylene multicomponent fibers and the monocomponent fibers can comprise polypropylene fibers. When made by the method described immediately above, the monocomponent fibers can have a fiber size approximately one half that of the multicomponent fibers and/or a denier approximately one fourth that of the multicomponent fibers. The present material is particularly well suited for use as or in a filtration media. The polypropylene fibers and/or comparable components can be treated so as to form an electret. Exemplary electret treatments are described in U.S. Pat. No. 4,375,718 to Wadsworth et al., U.S. Pat. No. 4,588,537 to Klaase et al., and U.S. Pat. No. 5,401,446 to Tsai et al.; the entire contents of the aforesaid patents are incorporated herein by reference. In addition, the individual fibers and/or components can contain one or more electret stabilization packages or materials such as, for example, those described in commonly assigned U.S. application Ser. No. 09/492,607 filed Jan. 27, 1999 to Myers et al., the entire contents of which is incorporated herein by reference.

In addition, the polymer composition comprising one of the components within the first continuous filaments desirably has a melting point at least 10° C. below that of the polymer composition comprising the other components therein as well as the polymer composition comprising the second continuous filaments. As a particular example, the first continuous filaments can comprise polypropylene/polyethylene bicomponent filaments and the second continuous filaments can comprise polypropylene. Utilizing such a combination of filaments allows the formation of autogenous interfiber bonds, such as by thermal bonding, wherein the majority of the interfiber bonds and even substantially all of the interfiber bonds are between the low melting polymer components of the multicomponent filaments. This is highly advantageous when utilizing electret materials in filtration or particle collection applications since it allows the monocomponent fibers and the high melting component of the multicomponent fibers to remain exposed.

Figure 4:
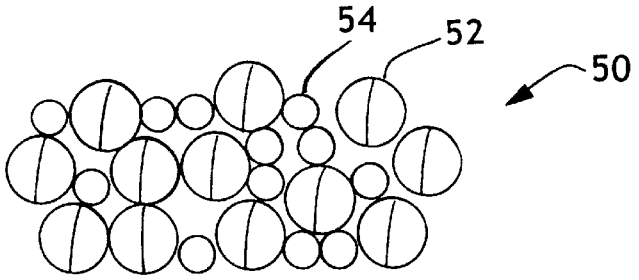
FIG. 4 is an enlarged cross-sectional view of a composite nonwoven web comprising a blend of bicomponent and monocomponent fibers.

In reference to FIG. 4, a cross-sectional side view of an integrated web 50 is depicted comprising bicomponent fibers 52 and monocomponent fibers 51. Due to the web lay-down processes utilized in forming nonwoven structures, the bicomponent and monocomponent fibers are deposited in the web in a random fashion thereby forming a non-uniform packing of large and small fibers and thus large to small pore diameters. This random distribution of large and small fibers and the corresponding mixture of large to small pores create a web structure with improved particle holding characteristics useful in filters, wipes and other like applications.

Figure 3:
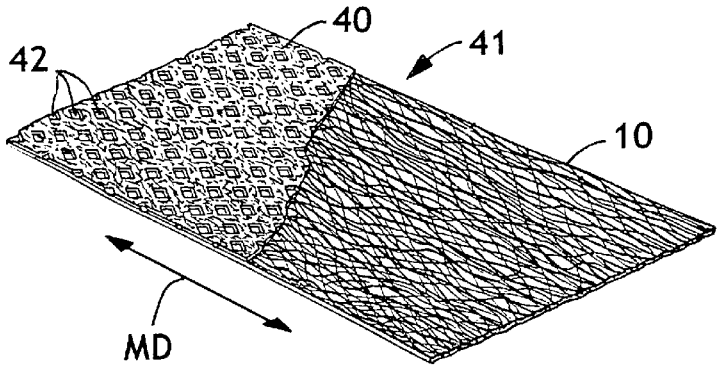
FIG. 3 is a partially elevated view of a multilayer nonwoven laminate incorporating the composite nonwoven web of FIG. 1.

The composite nonwoven webs of the present invention can be used alone or in combination with other layers or materials. In this regard, it may often be desirable to incorporate the nonwoven webs of the present invention within a multilayer laminate structure. As used herein "multilayer laminate" simply refers to a multilayer structure wherein two or more layers are fixedly attached to one another in a face-to-face relationship. One or more nonwoven webs of the present invention can be laminated to one or more additional layers or materials such as, for example, films, knitted or woven fabrics, foams, scrims, nonwoven fabrics, air-laid materials and so forth. The multiple layers can be fixedly attached by one or means known in the art such as mechanically, ultrasonically, thermally or adhesively attaching the layers. In applications where high bulk and/or improved fluid handling properties are of significant value, it may often be desirable in such instances to bond the web without using significant compacting force thereby forming a nonwoven web having a substantially uniform thickness and porosity. An exemplary non-compacting bonding process includes, for example, through air bonding processes. In one embodiment and in reference to FIG. 3, laminate 41 can comprise nonwoven composite web 10 and second homogeneous nonwoven web 40. The respective layers can each comprise thermoplastic polymers and can be thermally bonded at points 42 to form integrated multilayer laminate 41. Exemplary multilayer nonwoven laminates include, by way of example only, those wherein one layer comprises a spunbond fiber web and a second comprises a meltblown fiber web; e.g. a spunbond/meltblown/spunbond (SMS) laminate. Exemplary multilayer laminates and methods of making the same are disclosed in U.S. Pat. No. 4,041,203 to Brock et al., U.S. Pat. No. 5,188,885 to Timmons et al. and U.S. Pat. No. 5,695,868 to McCormack. SMS laminates may be made by sequentially depositing onto a moving forming belt first a spunbond fabric layer, then a meltblown fabric layer and last another spunbond layer and then bonding the laminate such as by thermal point bonding. Alternatively, the individual layers or fabrics may be made individually, collected in rolls, and combined in a separate bonding step.

Figure 2:
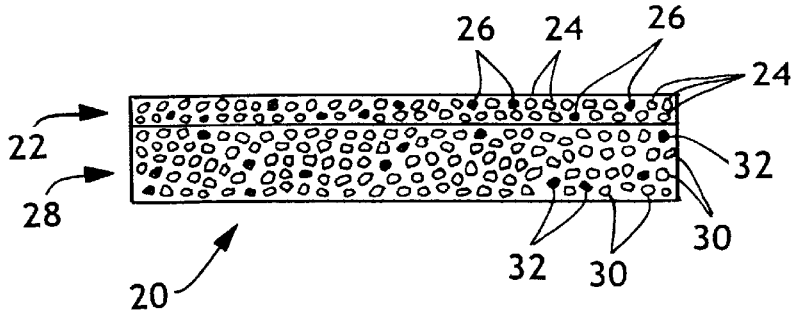
FIG. 2 is a cross-sectional view of a multilayer nonwoven web comprising first and second composite nonwoven webs of the present invention.

Further, multiple layers of nonwoven webs of the present invention can themselves be bonded together to form multilayer laminates. In reference to FIG. 2, multilayer laminate 20 comprises first composite nonwoven web 22 and second composite nonwoven web 28. First layer 22 can comprise a first nonwoven web having a blend or mixture of first continuous filaments 24 and second continuous filaments 26 and second layer 28 can comprise a second nonwoven web having a blend or mixture of first continuous filaments 30 and second continuous filaments 32. Thus, nonwoven webs having varied physical attributes can be laminated to one another thereby forming a multilayer laminate having improved overall characteristics relative to those the individual first and second layers. As an example, the first nonwoven web 22 and second nonwoven web 28 can comprise similar and/or identical first filaments 24 and 30 wherein only the second filaments 26 and 32 of the respective layers differ. In a further aspect, the first filaments 26, 30 and second filaments 26, 32 of the respective layers can comprise identical fibers wherein the ratio of first filaments to second filaments differ in the first and second webs 22, 28. Numerous additional combinations of composite nonwoven webs of the present invention are possible.

The composite nonwoven fabrics of the present invention, and laminates thereof, can be utilized for or as a component in garments such as industrial workwear, undergarments, pants, shirts, jackets, gloves, socks, and so forth. Further, the composite nonwoven fabrics of the present invention, and laminates thereof, can be utilized in medical or infection control products such as surgical gowns and drapes, face masks, head coverings, surgical caps and hoods, shoe coverings, boot covers, wound dressings, bandages, sterilization wraps, wipers, patient bedding and so forth. Still further, composite nonwoven fabrics of the present invention, and laminates thereof, can be utilized in one or more various aspects as a component within personal care products, e.g. personal hygiene oriented items such as diapers, training pants, absorbent underpants, adult incontinence products, feminine hygiene products, and the like. As specific non-limiting examples thereof, the nonwoven webs of the present invention and/or laminates thereof can be used in conjunction with or in a manner as described in the following references: U.S. Pat. No. 4,965,122 to Morman et al., U.S. Pat. No. 5,336,545 to Morman et al., U.S. Pat. No. 4,720,415 to Vander Wielen et al., U.S. Pat. No. 5,540,976 to Shawver et al., U.S. Pat. No. 3,949,128 to Ostermeier, U.S. Pat. No. 5,620,779 to Levy et al., U.S. Pat. No. 5,714,107 to Levy et al., U.S. Pat. No. 5,188,885 to Timmons et al., U.S. Pat. No. 5,721,180 to Pike et al., U.S. Pat. No. 5,817,584 to Singer et al., U.S. Pat. Nos. 5,639,541 and 5,811,178 to Adam et al., U.S. Pat. No. 5,385,775 to Wright et al, U.S. Pat. Nos. 4,853,281 and 4,833,003 to Win et al., U.S. Pat. No. 5,486,166 to Bishop et al. and U.S. Pat. No. 5,562,650 to Everett et al. The aforesaid list of applications of nonwoven webs and multilayer laminates thereof is not exhaustive and there exist numerous additional uses for the fabrics of the present invention.

While various patents and other references have been incorporated herein by reference, to the extent incorporated material is inconsistent with that of the written specification the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

We claim:

1. A composite nonwoven web comprising:

a continuous filament nonwoven web having first continuous filaments and second continuous filaments extending substantially in the machine direction;

said first continuous filaments comprising multicomponent filaments and comprise at least about 50% of said composite nonwoven web;

said second continuous filaments comprising monocomponent filaments and having an average denier less than that of the said first continuous filaments and wherein said second continuous filaments comprise from about 10% to about 40% of said composite nonwoven web;

said composite nonwoven web having autogenous interfiber bonds.

2. The composite nonwoven web of claim 1 wherein said first continuous filaments and said second continuous filaments have a denier ratio of not less than about 2:1.

3. The composite nonwoven web of claim 2 wherein the first continuous filaments comprise filaments having a helical crimp.

4. The composite nonwoven web of claim 3 wherein said first continuous filaments comprises at least first and second components each forming a portion of the outer surface of the first continuous filaments and wherein said first component comprises a first propylene polymer composition and said second component comprises a different polymer composition having a melting point at least 10° C. below that of said first propylene polymer composition.

5. The composite nonwoven web of claim 4 wherein said web has a substantially uniform thickness.

6. The composite nonwoven web of claim 5 wherein said second continuous filaments comprise a second propylene polymer composition.

7. The composite nonwoven web of claim 6 wherein said first component of said first continuous filaments and said second continuous filaments comprise an electret.

8. The composite nonwoven web of claim 7 wherein said second continuous filaments comprise between about 20% and about 35% of said composite nonwoven web.

9. The composite nonwoven web of claim 7 wherein said first continuous filaments comprise polypropylene/polyethylene bicomponent filaments.

10. The composite nonwoven web of claim 9 wherein said first continuous filaments comprise multilobal filaments.

11. The composite nonwoven web of claim 1 wherein said first continuous filaments comprises at least first and second components each forming a portion of the outer surface of the first continuous filaments and wherein said first component comprises a first propylene polymer composition and said second component comprises a different polymer composition having a melting point at least 10° C. below that of said first propylene polymer composition.

12. The composite nonwoven web of claim 11 wherein the autogenous interfiber bonds are primarily located between said first continuous filaments.

13. The composite nonwoven web of claim 12 wherein said polypropylene polymer compositions comprise an electret.

14. The composite nonwoven web of claim 13 wherein second component of said first continuous filaments comprises an ethylene polymer.

15. The composite nonwoven web of claim 14 wherein said autogenous interfiber bonds are formed by thermally bonding said filaments with heated air.

16. The composite nonwoven web of claim 2, wherein the denier ratio is between about 2:1 and about 15:1.

17. The composite nonwoven web of claim 16, wherein the denier ratio is about 4:1.

18. The composite nonwoven web of claim 11, wherein said second continuous filaments comprise a second propylene polymer compositon.

* * * * *